United States Patent [19]

Matsumura et al.

[11] Patent Number: 4,952,837

[45] Date of Patent: Aug. 28, 1990

[54] SURFACE GAP TYPE IGNITER PLUG

[75] Inventors: Shuzo Matsumura; Takahiro Suzuki, both of Nagoya, Japan

[73] Assignee: NGK Spark Plug Co., Ltd., Nagoya, Japan

[21] Appl. No.: 313,744

[22] Filed: Feb. 22, 1989

[30] Foreign Application Priority Data

May 9, 1988 [JP] Japan ..... 63-112228

[51] Int. Cl.[5] ..... H01T 13/20; H01T 13/34

[52] U.S. Cl. ..... 313/135; 313/137; 313/144

[58] Field of Search ..... 313/135, 136, 137, 144, 313/145

[56] References Cited

U.S. PATENT DOCUMENTS

| | | | |
|---|---|---|---|
| 2,478,087 | 8/1949 | Bychinsky et al. | 313/135 X |
| 3,257,503 | 6/1966 | Lentz et al. | 313/144 X |
| 3,452,235 | 6/1969 | Hallauer et al. | 313/145 X |

*Primary Examiner*—Sandra L. O'Shea
*Attorney, Agent, or Firm*—Cooper & Dunham

[57] ABSTRACT

A surface gap type igniter plug comprising; a cylindrical metallic shell; a tubular insulator inserted into said metallic shell with a rear end projected from that of the insulator; a center electrode disposed to position at an innerside of the insulator, the electrode making its rear end of the insulator; a sleeve terminal located between an outerside of the electrode and an innerside of the insulator, the terminal being secured at a rear end to the center electrode by means of welding; a connector having an insulator sleeve interfit into an innerside of a metallic sleeve, the insulator sleeve being terminated short of a front end of the metallic sleeve; and the connector being securely capped to the metallic shell at a time of assemblage with the rear end of the tubular insulator interfit into an innerside of the insulator sleeve, and with the metallic shell interfit into an innerside of the metallic sleeve.

9 Claims, 3 Drawing Sheets

SURFACE GAP TYPE IGNITER PLUG

BACKGROUND OF THE INVENTION

1. Field of the Invention

This invention relates to a surface gap type igniter plug for use in various types of internal combusion engines, gas burner and the like, and particularly concerns to connecting structure between connector and metallic shell.

2. Description of the Prior Art

This kind of igniter plug has been introduced as of a low voltage surface gap type shown in FIG. 3 at (B) by way of illustration.

The igniter plug (B) has a plug body 100, a metallic barrel 200, a connector 300 and a sleeve terminal 330. The plug body 100 has a cylindrical metallic shell 110 into which an annular semi-conductor tip 120 and a tubular insulator 130 are serially located.

Into serial bores of the tip 120 and the insulator 130, is a center electrode 140 placed which consists of an insert axis 141 and a discharge tip 146 each serially connected by means of welding. A rear end of the insert axis 141 is redundantly projected from that of the insulator 130, and enclosed by an insulator tube 142. A sealant glass 150 is provided with a space between the center electrode 140 and the insulator 130 at the position in which the tip 146 and the insert axis 141 are welded. The metallic barrel 200 is securely connected to a rear end of the metallic shell 110 of welding as designated by numeral 160. The connector 300 has an insulator sleeve 310 interfit into an innerside of a metallic sleeve 320, the front end of which is brazed to a rear end of the metallic sleeve 320 of the metallic barrel 200 as seen at numeral 250. The insulator sleeve 310 has a diameter-reduced portion at its front end which extends into the rear end of the metallic barrel 200, and encloses the insulator tube 142. The sleeve terminal 330 is interfit between a rear portion of the insulator sleeve 310 and that of the insert axis 141, both the rear ends being arranged in flush with each other, and secured by means of brazing as seen at numeral 350.

The igniter plug (B) has been assembled in the following procedures.

(1) The plug body 100 is welded or brazed at 160 to the metallic barrel 200 after completed the plug body 100.

(2) The insulator sleeve 310 is inserted into the metallic sleeve 320, and brazed to the metallic barrel 200 as indicated by 250.

(3) The sleeve terminal 330 is brazed at 350 to the insert axis 141 while heat remained by the braze operation 250 is kept.

The above igniter, however, has disadvantages as follows:

Firstly, preceding procedures are rendered ineffective, once defects occur at the post procedure (3), thus leading to an increased cost.

Secondly, the procedure at (3) is done at a reduced space in the metallic sleeve 320, thus requiring well-trained and skilled technique.

Therefore, it is object of this invention to provide a surface gap type igniter plug which can be easily assembled with least defect, and making it possible to easily weld a sleeve terminal to a center electrode, at the same time, securing positive contact between the terminal and the electrode without introducing an insufficient contact therebetween.

Accordingly there is provided a surface gap type igniter plug comprising; a cylindrical metallic shell; a tubular insulator inserted into said metallic shell with a rear end projected from that of the insulator; a center electrode disposed to position at an innerside of the insulator, the electrode making its rear end projected from the rear end of the insulator; a sleeve terminal located between an outerside of the electrode and an innerside of the insulator, the terminal being secured at a rear end to the center electrode by means of welding; a connector having an insulator sleeve interfit into an innerside of a metallic sleeve, the insulator sleeve being terminated short of a front end of the metallic sleeve; and the connector being securely capped to the metallic shell at a time of assemblage with the rear end of the tubular insulator interfit into an innerside of the insulator sleeve, and with the metallic shell interfit into an innerside of the metallic sleeve.

DETAILED DESCRIPTION OF THE INVENTION

Figure 1:
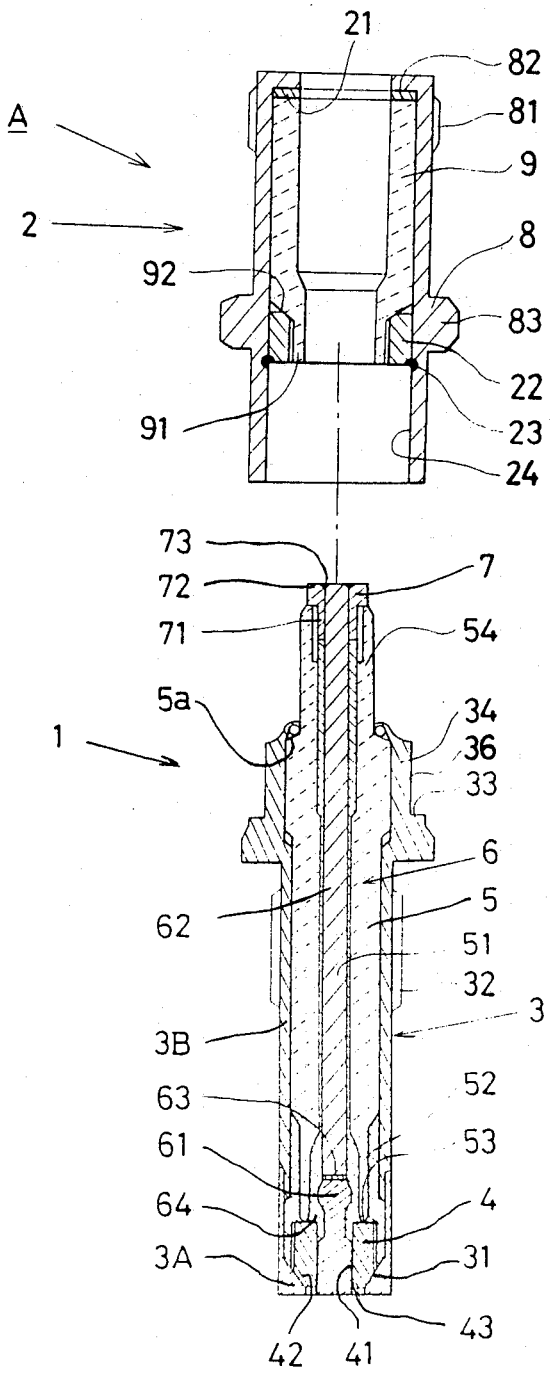
FIG. 1 is an exploded cross-sectional view of a surface gap type igniter plug according to the embodiment of this invention.
Figure 2:
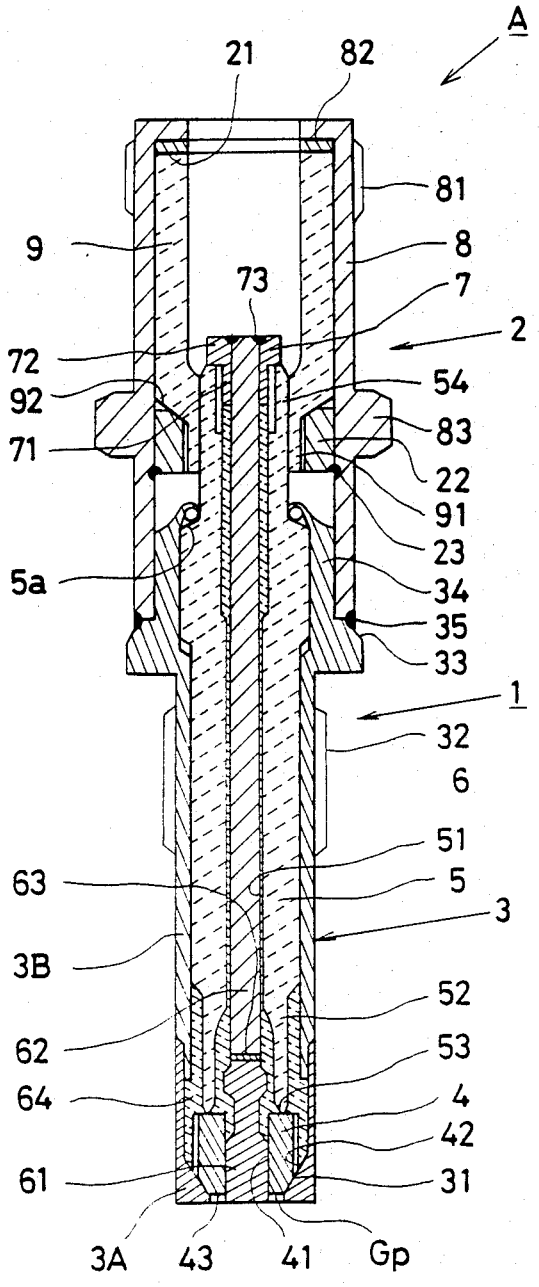
FIG. 2 is a longitudinal cross-sectional view of a surface gap type igniter plug according to the embodiment of this invention.

In reference with FIGS. 1 and 2 of the drawings in particular an igniter plug is of low voltage surface gap type as designated at denotation (A) in which a plug body 1 and a connector 2 is provided. The plug body 1 includes a cylindrical metallic shell 3, an annular semi-conductor tip 4 and a tubular insulator 5 serially connected and each located at the innerside of the metallic shell 3. Inside a bore 51 of the tubular insulator 5, is an elongated center electrode 6 located, to a rear end of which a sleeve terminal 7 is attached.

The metallic shell 3 has a housing portion 3B, a front end of which is connected to a rear end of an annular fire tip 3A. The housing portion 3B is made of stainless steel, while the fire tip 3A being made of heat and are resistant materials such as SUS 304, Inconel or tungsten based alloy. The metallic shell 3 has a tapered inner surface 31 at the fire tip 3A, a male thread 32 at an outer surface of the housing portion 3B, and a flange 33 at a rear end portion thereof. A rear end 34 of the metallic shell 3 is caulked to engage with a step portion 5*a* of the insulator 5 to axially push the insulator 5.

The semi-conductor tip 4 is made of a sintered compact with silicon carbide (SiC), alumina ($Al_2O_3$) and magnesium oxide (MgO) as main components. The tip 4 has an outer beveled portion 42 to engage with the tapered surface 31 and, at the same time, having a front end surface 43 and a central bore 41, the latter of which surrounds discharge tip 61 as described hereinabove. Tip 4 is located to provide a surface discharge gap (Gp) between tip 4 and metallic shell 3 by way of the front end surface 43.

The tubular insulator 5 made of ceramic material with alumina as a main component, and thickness-reduced portion 52 at a front region, so that an inner diameter is greater than an outer diameter of the center electrode 6, while an outer diameter is smaller than an inner diameter of the metallic shell 3. A front end 53 of the thickness-reduced portion 52 extends to the neighborhood of a rear end of the semi-conductor tip 4 otherwise engages with the rear end of the semi-conductor tip 4. A rear end portion 54 of the insulator 5 extends beyond the rear end 34 of the metallic shell 3.

The center electrode 6 has the discharge tip 61 of tungsten-based alloy and an insert axis 62 of nickel-based alloy each serially connected inside of the thickness-reduced portion 52 by means of welding as seen at numeral 63. The discharge tip 61 is inserted into the central bore 41 of the semi-conductor tip 4 and slightly extends beyond a lowerest end 43 the semi-conductor tip 4 to be in flush with the rear end of the fire tip 3A. The insert axis 62 extends its rear end beyond the rear end portion 54 of the insulator 5.

A glass sealant 64 is encapsulated into an annular space between the thickness-reduced portion 52 and the center electrode 6, and a space between the thickness-reduced portion 52 and the fire tip 3A.

A sleeve terminal 7 has sleeve body 71 and diameter-increased head portion 72. The diameter-increased head portion 72 overhangs to engage with the rear end portion 54 of the insulator 5, while the sleeve body 71 is inserted between the insert axis 62 and the rear end portion 54. In this situation, the insert axis 62 extends its rear end through a bore of the sleeve terminal 7 to be in flush with the rear end of the terminal 7. The insert axis 62 and the sleeve terminal 7 are brazed at the flush surface as indicated by numeral 73 so as to secure terminal 7 to center electrode 6. The insert axis 62, however, may be secured to terminal 7 by thermally fusing, such as welding or the like.

In the meantime, a connector 2 has an insulator sleeve 9 interfit into an inner wall of a metallic sleeve 8. The insulator sleeve 9 terminates its front end somewhat short of that of the metallic sleeve 8. The metallic sleeve 8 further has a connector thread 81 at an outer rear surface thereof, and at the same time, having a stop rim 82 at an inner rear surface of the sleeve 8 so as to be brought into engagement with the rear end of the insulator sleeve 9 by way of a washer 21. In the middle of the metallic sleeve 8, is a hexagonal portion 83 integrally formed for the sake of convenience at the time of mounting. The insulator sleeve 9 is made of the same material as the tubular insulator 5, and constricted at a front portion 91 through a step area 92 to correspond to the rear end portion 54 of the insulator 5.

In this instance, a stop ring 22 is placed into an innerside of the metallic sleeve 8 to position remote from the connector thread 81, and telescoped into an outerside of the constricted portion 91. The ring 22 is welded or brazed to the inner wall of the metallic sleeve 8 as indicated by a black dot 23. The insulator sleeve 9 is in such a configuration as lengthwisely sandwiched by the stop rim 82 and the stop ring 22 to be securely positioned.

The connector 2 is securely capped to the metallic shell 3 in a manner that the rear end portion 54 of the insulator 5 is interfit into the constricted front portion 91, while the rear end 34 of the metallic shell 3 being interfit into the front end of the metallic sleeve 8. During this interfitting process, the sleeve end engages with flange 33, and welded at a engagement portion as seen by numeral 35.

According to this embodiment, the igniter plug (A) is assembled as follows:

(1) The connector 2 is assembled after the plug body 1 is completed.

(2) The connector 2 is capped to the metallic shell 3, and welded at the engagement portion 35 between the flange 33 and the front end of the metallic sleeve 8.

As understood from the foregoing description, the following advantages are obtained according to this invention.

(i) The brazing operation between the insert axis 62 and the sleeve terminal 7 can be carried out with the connector 2 unassembled as seen in FIG. 1. Thus makes the brazing operation easy. In addition, the finished condition of the braze is visually examined with ease, thus reducing braze defects to a considerable degree.

(ii) The assemble is completed by the comparatively easy weld operation between the metallic sleeve 8 and the metallic shell 3, thus avoiding preceding assemble procedures from being ineffective, and reducing chances of defective products to appear.

(iii) The welding or brazing operation between the stop ring 22 and the metallic sleeve 8 can be conducted remote from the position of the connector thread 81, thus avoiding the thread 81 from being thermally deformed.

In addition, this eliminates the need of removing fluxes which otherwise would penetrate into the thread 81 at the time of welding operation.

Figure 3:
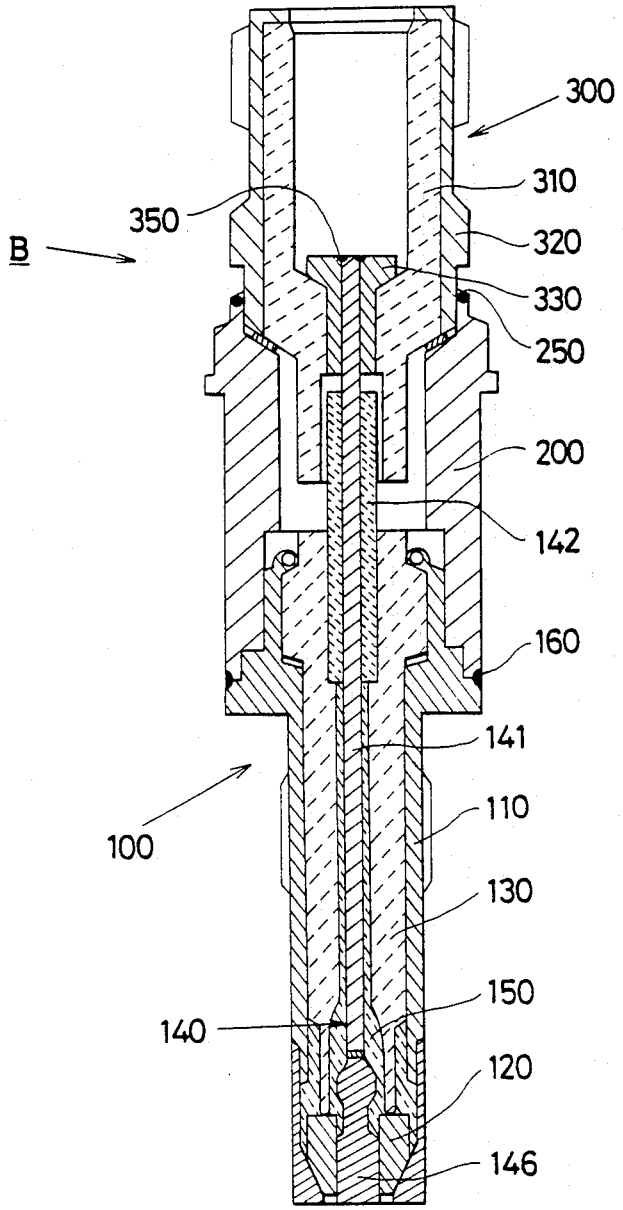
Fig. 3 PRIOR ART
FIG. 3 is a view similar to FIG. 2 according to prior art.

(iv) Compared to the prior art of FIG. 3, those components equivalent to the barrel 200 and the insulator tube 142 can be omitted, thus reducing the number of component parts together with reducing of assemble procedures.

It is noted that the plug according to this invention can be applied to a plug of high voltage type.

Further, it is appreciated that instead of welding 35 , the sleeve 8 may be secured to the flange 33 by means of thermal fusion such as brazing.

In addition, the sleeve terminal 7 may be incorporated into the rear end of the insert axis 62 to constitute a part of the center electrode 6.

Furthermore, the metallic sleeve 8 may have a female thread (not shown) at the inner wall, while the rear end 34 of the metallic shell 3 may have a male thread (not shown) at the outer wall 36 as shown in FIG. 1. The sleeve 3 may be secured to the metallic shell 3 by screwing the male thread into the female thread instead of securing the engagement portion 35 by welding.

The invention is not limited to the embodiments described above, but all changes and modifications thereof, not constituting departures from the spirit and scope of the invention, are intended to be included.

What is claimed is:

1. A surface gap type igniter plug comprising;

a cylindrical metallic shell;

a tubular insulator inserted into said metallic shell with a rear end projected from that of said insulator;

a center electrode disposed to position at an innerside of said insulator, the electrode making its rear end projected from the rear end of said insulator;

a sleeve terminal located between an outerside of said electrode and an innerside of said insulator, the terminal being secured at a rear end to said center electrode by means of thermal fusion;

a connector having an insulator sleeve interfit into an innerside of a metallic sleeve, the insulator sleeve being terminated short of a front end of said metallic sleeve; and said connector being securely capped to said metallic shell at a time of assemblage with the rear end of said tubular insulator interfit into an innerside of said insulator sleeve, and with said metallic shell interfit into an innerside of said metallic sleeve.

2. A surface gap type igniter plug as recited in claim 1, in which said sleeve terminal integrally has an upper diameter-increased head portion, an under surface of which overhangs to engage with the rear end of said tubular insulator.

3. A surface gap type igniter plug as recited in claim 1, in which the rear end of said center electrode is in flush with that of said sleeve terminal.

4. A surface gap type igniter plug as recited in claim 1, in which said connector has a connector thread at a rear surface of said metallic sleeve, and a stop ring is welded to an innerside of said metallic sleeve to secure said insulator sleeve, the stop ring being located remote from said connector thread.

5. A surface gap type igniter plug as recited in claim 4, said metallic sleeve has a hexagonal portion at its outer surface.

6. A surface gap type igniter plug as recited in claim 1, said tubular insulator is made of ceramic material with alumina as a main component.

7. A surface gap type igniter plug as recited in claim 1, said center electrode consists of discharge tip and an insert axis.

8. A surface gap type igniter plug as recited in claim 7, said discharge tip made of tungsten-based alloy while said insert axis being made of nickel-based alloy, said discharge tip and said insert axis is serially connected substantially at a front portion of said tubular insulator by means of welding.

9. A surface gap type igniter plug as recited in claim 1, said insulator sleeve is made of ceramic material with alumina as a main component.

* * * * *